US011247795B2

(12) United States Patent
Pasini et al.

(10) Patent No.: US 11,247,795 B2
(45) Date of Patent: Feb. 15, 2022

(54) MACHINE FOR FORMING FILTER BAGS FOR INFUSION PRODUCTS

(71) Applicant: I.M.A. INDUSTRIA MACCHINE AUTOMATICHE S.p.A., Ozzano Dell'Emilia (IT)

(72) Inventors: Fabio Pasini, Ozzano Dell'Emilia (IT); Sauro Rivola, Ozzano Dell'Emilia (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 237 days.

(21) Appl. No.: 16/462,995

(22) PCT Filed: Dec. 18, 2017

(86) PCT No.: PCT/IB2017/058050

§ 371 (c)(1),
(2) Date: May 22, 2019

(87) PCT Pub. No.: WO2018/116120

PCT Pub. Date: Jun. 28, 2018

(65) Prior Publication Data

US 2019/0291905 A1 Sep. 26, 2019

(30) Foreign Application Priority Data

Dec. 20, 2016 (IT) ..... 102016000128479

(51) Int. Cl.
*B65B 29/02* (2006.01)
*B65B 43/04* (2006.01)
(Continued)

(52) U.S. Cl.
CPC ..... *B65B 29/028* (2017.08); *B65B 43/04* (2013.01); *B65B 43/465* (2013.01); *B65B 61/06* (2013.01)

(58) Field of Classification Search
CPC ..... B65B 29/028; B65B 43/04; B65B 43/465; B65B 61/06; B65B 11/28; B65B 11/36; B65B 29/02; B65B 29/04
(Continued)

(56) References Cited

U.S. PATENT DOCUMENTS 6,499,273 B1 * 12/2002 Marzocchi ..... B65B 29/04 493/226
6,637,175 B2 * 10/2003 Ghirlandi ..... B65B 29/028 53/413
(Continued)

FOREIGN PATENT DOCUMENTS

CN 1141230 C 3/2004
CN 101454207 A 6/2009
(Continued)

OTHER PUBLICATIONS

International Search Report and Written Opinion dated Mar. 3, 2018 for counterpart PCT Application No. PCT/IB2017/058050.
Chinese Office Aciton dated Jul. 28, 2020 from counterpart Chinese Patent Application No. 201780078755.5.

*Primary Examiner* — Anna K Kinsaul
*Assistant Examiner* — Veronica Martin
(74) *Attorney, Agent, or Firm* — Shuttleworth & Ingersoll, PLC; Timothy Klima

(57) ABSTRACT

A machine for forming filter bags for infusion products, starting from pieces of filter material feeding along a feed line, includes: a movement carousel rotating continuously about an axis; a plurality of grippers positioned along, and movable continuously with, the carousel, each gripper configured for retaining a respective piece of filter material; a plurality of operating stations positioned along, and movable continuously with, the carousel; each operating station associated with a gripper and configured to operate on the piece of filter material to form, at least partly, a filter bag along a
(Continued)

predetermined angular stretch of rotation of the carousel; a plurality of translation devices, associated with the carousel and configured for translating a gripper along a direction parallel to the axis to bring the corresponding gripper to the respective pieces of filter material at least for a stretch of the feed line.

11 Claims, 9 Drawing Sheets

(51) Int. Cl.
*B65B 43/46* (2006.01)
*B65B 61/06* (2006.01)

(58) Field of Classification Search
USPC ..... 53/134.1, 134.2, 547, 243
See application file for complete search history.

(56) References Cited

U.S. PATENT DOCUMENTS

| | | | | |
|---|---|---|---|---|
| 6,837,024 | B1 * | 1/2005 | Romagnoli | B65B 29/028 53/170 |
| 2017/0233120 | A1 * | 8/2017 | Spatafora | B65D 85/808 53/134.2 |

FOREIGN PATENT DOCUMENTS

| | | | |
|---|---|---|---|
| EP | 762973 | A1 | 3/1997 |
| EP | 762974 | A1 | 3/1997 |
| EP | 765274 | A1 | 4/1997 |
| WO | 9631395 | A1 | 10/1996 |
| WO | 2005056386 | A1 | 6/2005 |
| WO | 2016029987 | A1 | 3/2016 |

* cited by examiner

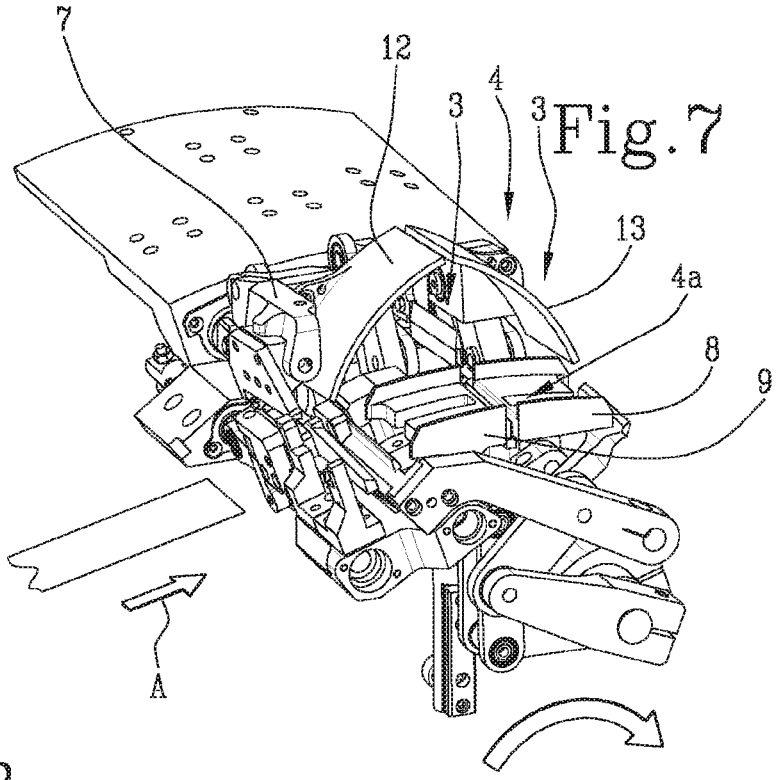
Fig.7
Fig.8
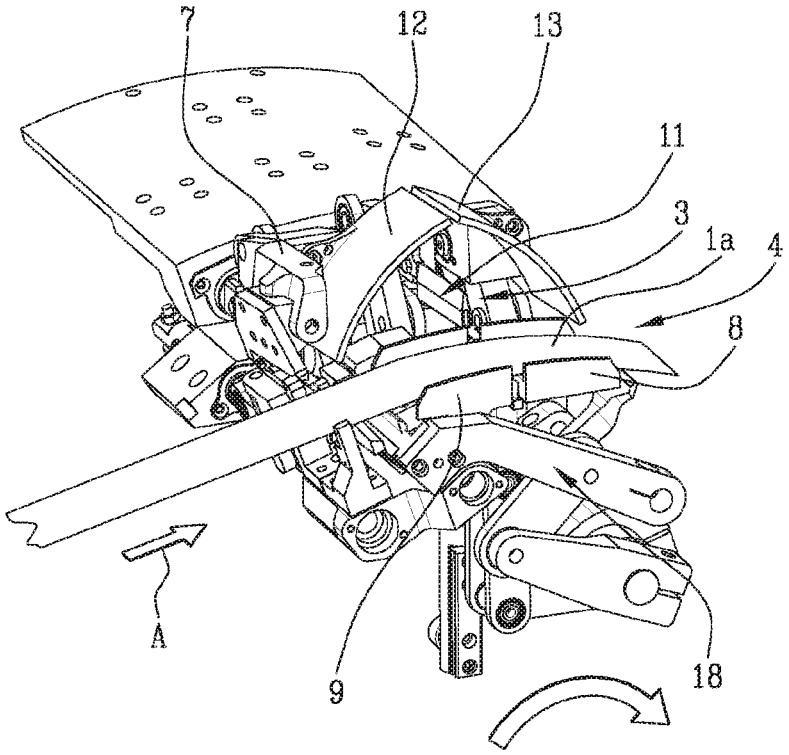

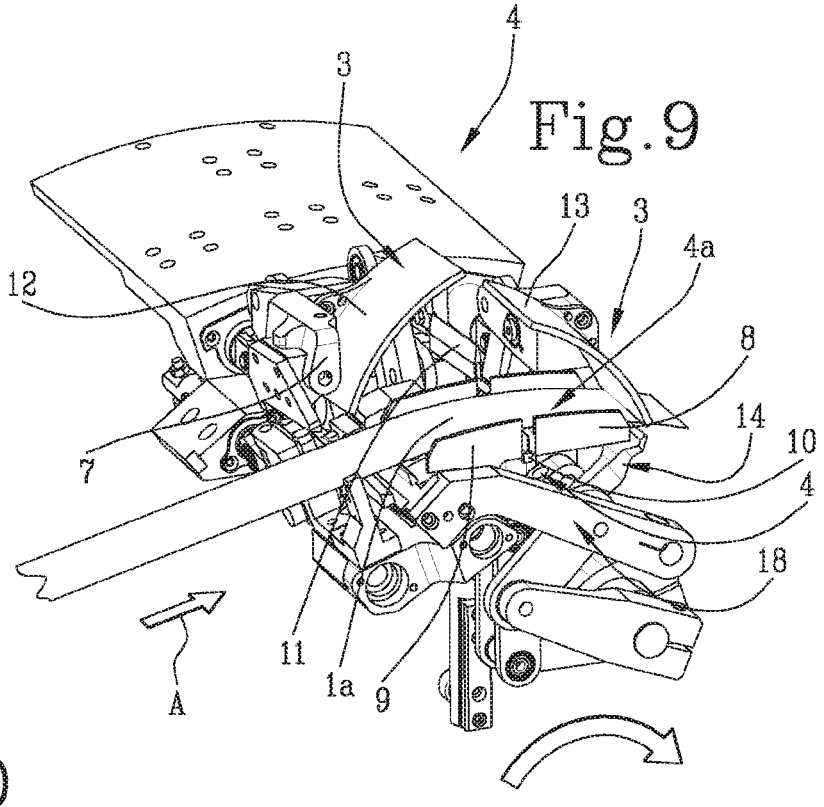
Fig.9
Fig.10
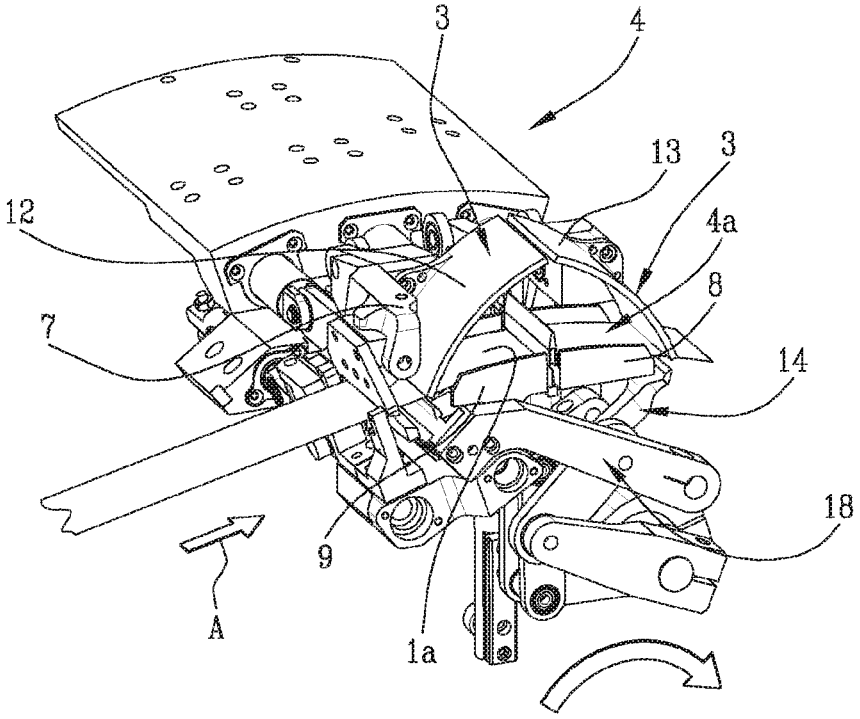

MACHINE FOR FORMING FILTER BAGS FOR INFUSION PRODUCTS

This application is the National Phase of International Application PCT/IB2017/058050 filed Dec. 18, 2017 which designated the U.S.

This application claims priority to Italian Patent Application No. 102016000128479 filed Dec. 20, 2016, which application is incorporated by reference herein.

TECHNICAL FIELD

This invention relates to a machine for forming filter bags for infusion products, such as tea, coffee, camomile (in powder, granular or leaf form).

BACKGROUND ART

The term filter bags is used to indicate at least two types of filter bag: the single-chamber filter bags, comprising, in a minimum configuration, a piece of filter material forming a chamber containing a dose of infusion product; and the double-chamber filter bags, again comprising a single piece of filter paper, but forming two separate chambers. Each chamber contains a dose of infusion product. The two chambers are folded towards each other forming a single upper end (in the shape of an upturned "V") and a bottom end in the shape of a "W".

The single-chamber and double-chamber filter bags can also be equipped with a tag and a tie string connecting the tag to the filter bag.

Lastly, an overwrap envelope may be added to the above mentioned filter bags for wrapping and closing the single filter bag, in a hermetic or non-hermetic manner.

A type of machine, used for making filter bags of the type called two-lobed, is known from patent documents EP762973, EP762974 and EP765274 (all in the name of the same Applicant).

The machine extends along a forming and feeding line on which are positioned:

- a station for feeding a web of filter paper along a feed surface;
- a station for feeding doses of product on the web of filter paper at predetermined distances;
- a tabularisation station for folding the strip on itself, wrapping the doses of product and, subsequently, longitudinally joining the strip;
- a station for folding individual pieces of filter paper with double chamber;
- a carousel, equipped with radially protruding grippers, positioned beneath the folding station and configured to receive individual pieces of folded filter paper; the carousel, moved stepwise about a horizontal axis, rotates each piece of filter paper to the operating stations, arranged one after another and stationary relative to a frame of the machine, to associate to the piece of filter paper a string, suitably wrapped around the piece of filter paper, and a tag in turn connected to the string.

In some machine solutions, depending on the type of filter bag to be formed, there may be (alternatively):

- a station for folding the open ends of the two chambers of the piece along the path of the carousel with their retaining by the knotting of the string on the same piece; or

- a further station for transversal closing of the ends of the piece before or at the same time as the separation from the remaining film.

The machine may also comprise a station for applying a sheet of overwrapping material for each filter bag positioned along the path of the carousel, or at a further carousel.

The machine structured as described above operates intermittently, that is to say, stepwise for all the stations present along the feed line.

The stepwise operation places a limit on the productivity of the machine.

DISCLOSURE OF THE INVENTION

The aim of this invention is to provide a machine for forming filter bags for infusion products with a productivity greater than the productivity of the prior art machines, maintaining a high quality of the filter bag.

More specifically, the aim of this invention to provide a machine for forming filter bags for infusion products with reduced dimensions and high flexibility.

These aims are fully achieved by a machine for forming filter bags for infusion products according to the appended claims.

BRIEF DESCRIPTION OF THE DRAWINGS

The invention will be described with reference to the accompanying drawings, provided by way of example only and without limiting the scope of the invention, in which:

FIGS. 7 to 10 are perspective views, each illustrating one of a plurality of stations arranged on the carousel shown in FIG. 6 in corresponding different operating configurations for forming the filter bag;

DETAILED DESCRIPTION OF PREFERRED EMBODIMENTS OF THE INVENTION

Figure 1:
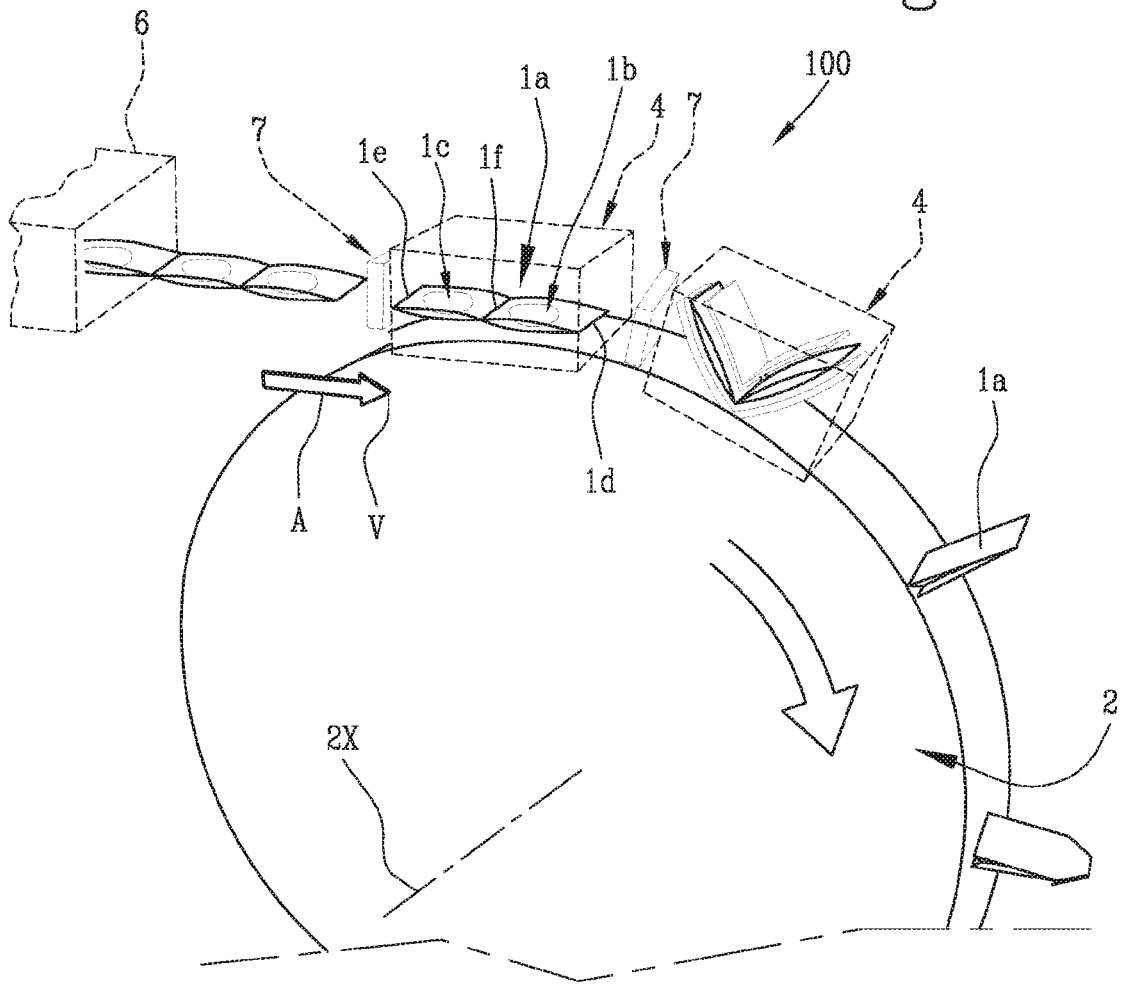
FIG. 1 is a schematic perspective view, with some parts cut away to better illustrate others, of a machine for forming filter bags for infusion products according to this invention.
Figure 6:
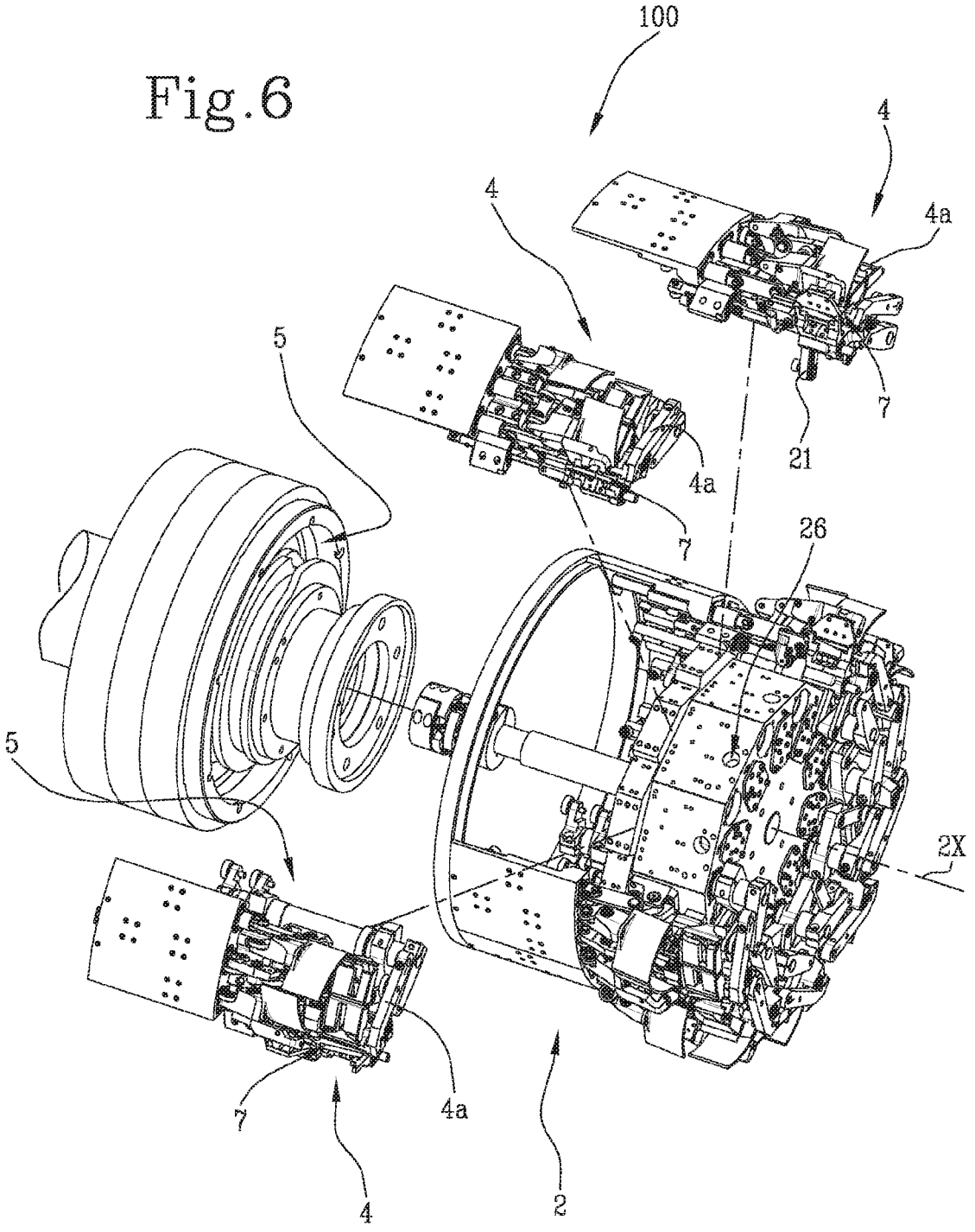
FIG. 6 is a perspective view, with some parts exploded, of a carousel forming the machine of FIG. 1.
Figure 15:
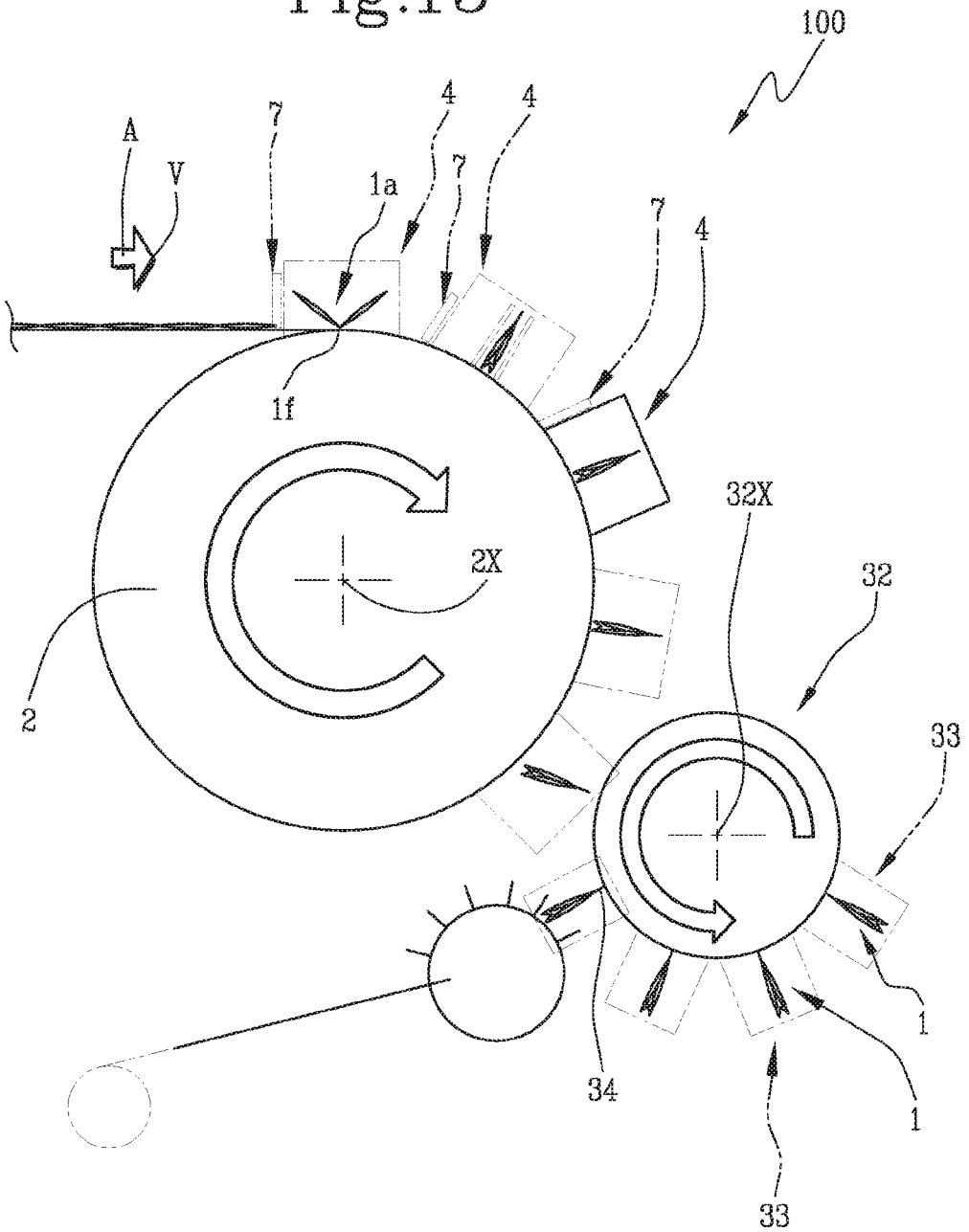
FIG. 15 illustrates the carousel of FIGS. 1 and 6 inserted in combination with a further carousel forming a variant of the machine according to the invention.

With reference to the accompanying drawings, a machine according to the invention, labelled 100 in its entirety in FIGS. 1, 6 and 15, is used for forming filter bags 1 containing infusion products, such as tea, coffee, camomile dosed in powder, granular or leaf form.

The filter bags 1 referred to in this specification are double chamber filter bags.

This type of filter bag 1 comprises a single piece 1*a* of filter material, which forms two separate chambers 1*b*, 1*c*. Each chamber 1*b*, 1*c* contains a dose of infusion product. The two chambers 1*b*, 1*c* are folded towards each other forming a single upper end (in the shape of an upturned "V") and a bottom end in the shape of a "W".

This type of filter bag may be equipped with a gripping tag and a tie string connecting the tag to the filter bag 1 formed (tag and tie string are not illustrated).

An outer overwrapping envelope may also be added to wrap around and enclose each single filter bag 1 formed.

The main aim of the machine 100 according to the invention is to at least form, through a suitable handling, the basic geometrical shape of the filter bag 1 with a double chamber starting from a piece 1*a* of filter material and folding it.

The machine 100, according to the invention may be used individually or in a more complex machine adding, when necessary, operating stations designed to perform the requested operation on the piece of filter material or on the filter bag (applying tie string and tag, and/or applying outer overwrapping envelope, etc), whilst maintaining a continuous operation of the machine.

The machine 100 for forming filter bags 1 for infusion products starting from pieces 1*a* of filter material each having, starting from pieces 1*a* of filter material each having two free ends 1*d*, 1*e* and an intermediate portion 1*f*.

Between each free end 1*d* and 1*e* and the intermediate portion 1*f* there are, respectively, two chambers 1*b*, 1*c* containing a corresponding dose of product.

Each piece 1*a* is fed along a feed line A with direction V.

As illustrated, the machine 100 comprises a first carousel 2 for continuous rotary movement about a first axis 2X of rotation.

The first carousel 2 has a circumferential surface extending parallel to the first axis 2X of rotation.

The machine 100 comprises a plurality of first gripping means 3 positioned along, and continuously movable with, the first movement carousel 2.

Each first gripping means 3 is configured for holding a respective piece 1*a* of filter material being formed.

The plurality of first gripping means 3 are distributed and equidistant along the entire circumference of the first carousel 2 and positioned on the circumferential surface of the first carousel.

The machine 100 also comprises a plurality of first operating stations 4 positioned along, and movable continuously with, the first movement carousel 2.

Each first operating station 4 is associated with a corresponding first gripping means 3.

Each first operating station 4 is configured to operate on the piece 1*a* of filter material in order to form, at least partly, a filter bag 1 along at least one predetermined angular stretch of rotation of the first movement carousel 2.

Advantageously, the first operating station 4 acts in conjunction with the corresponding first gripping means 3 for retaining the respective piece 1*a* of filter material being formed.

The plurality of first operating stations 4 are distributed and equidistant along the entire circumference of the first carousel 2 and positioned on the circumferential surface of the first carousel 2.

The machine 100 also comprises a plurality of first translation devices 5, associated with the first movement carousel 2 and configured for translating, mutually, the first operating stations 4 and the corresponding first gripping means 3 along a direction parallel to the axis 2X of rotation (see FIGS. 7 to 15).

The plurality of first translation devices 5 are distributed and equidistant along the entire circumference of the first carousel 2.

Each translation device 5 is positioned, at least partly, on a corresponding operating station 4 to define at least a part of the gripping means 3.

In light of this, as described below, at least a part of each translation device 5 is movable in both directions along the entire circumferential surface of the first carousel 2. In short, the basic concept of the machine 100 is that it comprises a multiplicity of operating units (wherein each operating unit comprises an operating station, gripping means and translation devices) engaging at 360° the circumferential surface of the first carousel, all operating a same operation on the piece of filter material, all independent of each other and driven continuously about an axis of rotation. Moreover, at the infeed area of the movement carousel 2, at which the piece 1*a* is fed to the feed carousel 2, the first operating station 4 and the corresponding first gripping means 3 are offset horizontally, that is, positioned on different vertical planes, in such a way as to allow the piece 1*a* to be easily received from the corresponding gripping means 3 or from the first feed station 4.

Next, a mutual movement, along a direction parallel to the first axis 2X of rotation, between the first operating station 4 and corresponding first gripping means 3 places the first operating station 4 and corresponding first gripping means 3 on a single vertical plane, in such a way that the first operating station 4 is positioned at the piece 1*a* and can perform one or more operations on the latter.

Upon completion of the operations, the first translation devices 5 again translate mutually the first operating station 4 and the corresponding first gripping means 3, in such a way that, at an outfeed area of the movement carousel 2, the piece 1*a* is free to be transferred to a subsequent processing step/station, for example a second movement carousel, or suitably stored if the formation is completed.

This configuration allows an intermediate operation or the completion of the filter bag to be obtained on a large number of pieces of filter material per unit of time and in a reduced space (angular section).

The first carousel 2 forms, as mentioned, a circumferential surface parallel to the first axis 2X of rotation on which are positioned the plurality of first operating stations 4, the corresponding plurality of operating means 3 and the plurality of translation devices 5.

Preferably, each first operating station 4 and the corresponding first gripping means 3 and part of the first translation device 5 are positioned on different vertical planes, parallel to the circumferential surface of the first carousel 2, at least for a stretch of the line A for feeding the pieces 1*a* of filter material being formed.

As shown in the accompanying drawings, the first translation devices 5 are configured to translate along a direction parallel to the axis 2X of rotation of the first movement carousel 2, and bring the first gripping means 3 (which are the end part of a part of the first translation devices 5) to corresponding first operating stations 4 with respective pieces 1*a* of filter material, at least for a stretch of the feed line A, along which the first operating stations 4 perform one or more operations on the piece 1*a* of filter material being formed.

In other words, the first station 4 is fixed relative to the first movement carousel 2, that is, rotatable as one with the first movement carousel 2, and it remains positioned on a single vertical plane. Upon completion of the operations on the piece 1*a* of filter material, the first translation device 5 translates the gripping means 3 away from the corresponding first station 4 parallel to the first axis 2X of rotation, the piece 1*a* of filter material remaining held by the first operating station 4.

In the case illustrated, it is possible to feed to the movement carousel pieces of filter material in a tubular shape and the operating stations are folding and closing stations designed to fold and close the piece for making a filter bag without the tie string and tag.

Therefore, the first operating station 4 may be configured to perform intermediate operations on the piece 1*a* of filter material (folding and closing of the piece), or to perform terminal operations and form a complete filter bag 1 starting from a piece of filter material (applying tie string and tag to pieces folded and closed), or to perform auxiliary operations on a complete filter bag 1 (application and sealing of a sheet of overwrapping material) along at least one predetermined angular stretch of rotation of the first movement carousel 2.

From these three examples it can already be noted how the solution proposed has characteristics of high operational flexibility, together with high productivity.

The structure of the units, each consisting of gripping means, operating stations and translation devices distributed along the carousel, allows the actuator and control devices to be simplified and, preferably, to join them together in the proximity of the axis of rotation in such a way as to reduce the machine dimensions and maintain a high level of precision.

In the specific case illustrated here, the machine 100 according to the invention is designed for making (as mentioned above) double chamber filter bags starting from a continuous tubular strip of filter material containing doses of product arranged in succession.

More specifically, the machine 100 illustrated serves to form the two-lobed pieces 1*a* and to fold them in the upright form with the ends closed and folded and with the bottom already in the form of a "W".

As illustrated in FIG. 1, a continuous strip of filter material in a tubular shape having a succession of doses of infusion product spaced from each other is fed to the first movement carousel 2.

The continuous strip advances, continuously, along the feed line A with a feed direction V directed towards the first carousel 2.

The machine 100 comprises a plurality of cutting means 7 positioned on, and movable in rotation with, the first movement carousel 2. Each cutting means 7 is positioned between, and associated with, a first operating station 4 and the corresponding first gripping means 3 (as described in more detail below).

The cutting means 7 are configured to separate the continuous strip of filter material in order to obtain a single piece 1*a* of filter material having two free ends 1*d* and 1*e* and an intermediate portion 1*f* (designed to form the bottom of the filter bag 1 formed), between each free end 1*d* and 1*e* and the intermediate portion 1*f* there being, respectively, two chambers 1*b*, 1*c* containing a corresponding dose of product.

FIG. 1 shows that the machine has a forming unit 6 configured for forming, and feeding to the first movement carousel 2, a continuous strip of filter material having chambers 1*b*, 1*c* with doses of product positioned one after the another along the feed line A and moved in the direction V.

The pieces 1*a* of filter material feed, continuously, along the feed line A with a feed direction V, from an infeed zone to an outfeed zone of the first movement carousel 2.

If the machine 100 must form two-lobed type filter bags with string and tag and, if necessary, wrapped in a sheet of overwrapping material, the machine 100, thanks to the relative modularity structure/flexibility comprises two or more movement carousels which are able to perform the steps/operations necessary for the complete formation of the filter bag 1 (partially visible in FIG. 15).

More in detail, as illustrated in FIG. 6, the first carousel 2, as mentioned, has a circumferential surface (so as to define a cylindrical surface with a constant thickness), parallel to the first axis 2X.

With reference in particular to FIG. 6, the machine 100 has each first station 4 positioned fixed with a relative operating portion 4*a* on a first part of the circumferential surface of the first carousel 2 close to the relative outer edge and along the feed line A.

The operating portion 4*a* is configured to receive the piece 1*a* of filter material.

In light of this, the gripping means 3 are positioned parallel to the first axis 2X of rotation and along a second part of the circumferential surface of the first carousel 2, inside and away from the outer edge of the carousel 2.

It should be noted that the first movement carousel 2 rotates continuously in a clockwise direction.

On this circumferential surface are arranged the first operating station 4 and the first gripping means 3 on different vertical planes parallel to the circumferential surface of the first carousel 2. Along this surface extend, parallel to the first axis 2X of rotation, the first translation devices 5.

Preferably, each first station 4 comprises two cradles 8, 9 positioned along the feed line A and in the operating portion 4*a*

Figure 2:
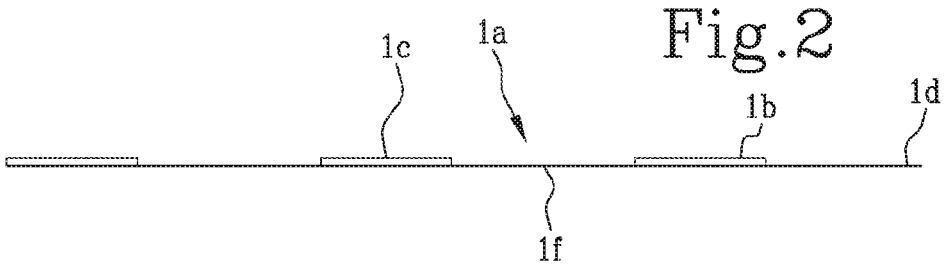
FIGS. 2 to 5 are schematic front views, with some parts cut away in order to better illustrate others, of a sequence of steps for forming a filter bag with the machine of FIG. 1.
Figure 3:
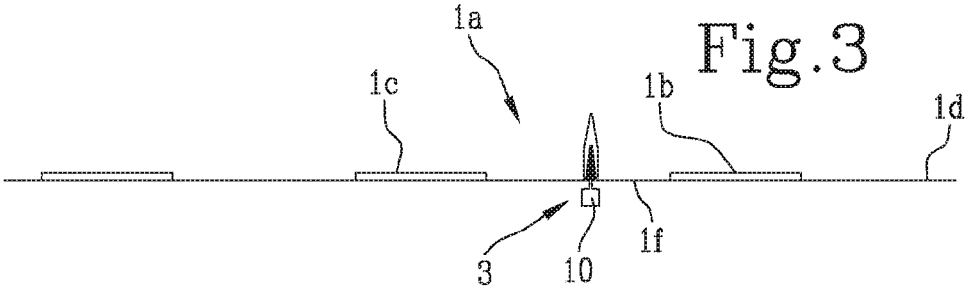
Figure 4:
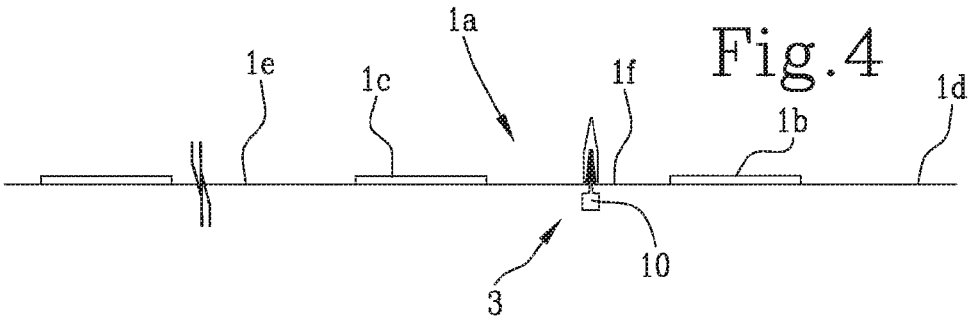

In light of this, the two cradles 8, 9 being configured to receive from the forming unit 6 and support along the first carousel 2, a portion of continuous strip of filter material having a pair of chambers 1*b*, 1*c* with doses of product (see FIGS. 2, 7 and 8).

The two cradles 8, 9 are arranged one after another along the feed line A and along the outer edge of the first carousel 2. The two cradles 8, 9 are separated from each other by a central channel parallel to the first axis 2X of rotation.

Preferably, each first gripping means 3 comprises a folder 10 and a counter-folder 11 of the intermediate portion 1*f* of the piece 1*a* of filter material located in the operating portion 4*a* of each first station 4 (that is, positioned on the two cradles 8, 9).

It should be noted that the folder 10 is positioned under the intermediate portion 1*f* of the piece 1*a* of filter material, in use, and positioned in the operating portion 4*a* (that is, on the two cradles 8, 9).

The folder 10 is movable, in phase with the counter-folder 11, along an axis X10 radial relative to the first axis 2X of rotation (see FIGS. 3, 4, 9, 10 and 16).

It should be noted that the folder 10 is positioned at the central channel of separation between the two cradles 8, 9.

The counter-folder 11 is configured to move between a withdrawn non-operating position, wherein the counter-folder 11 is moved away from the operating portion 4*a* of the first station 4 (FIG. 9), and a forward folding operating position, wherein the counter-folder 11, by a means of roto-translation, is positioned in the operating portion 4*a* and facing the folder 10 with the interposing of the intermediate portion 1*f* of the piece 1*a* of filter material (FIGS. 3, 4 and 10), in such a way as to stop the same piece 1*a* in a predefined position on the operating portion 4*a*.

In short, the folder 10 and the counter-folder 11 have two functions: they act on the central part of the piece 1*a* of filter material blocking the piece 1*a* in a predetermined position on the cradles 8, 9 and, as described in more detail below, forming the bottom end in the shape of a "W" of the filter bag 1 being formed.

Each first gripping means 3 also comprises a first tile 12 and a second tile 13 for covering the corresponding operating portion 4*a*.

Figure 12:
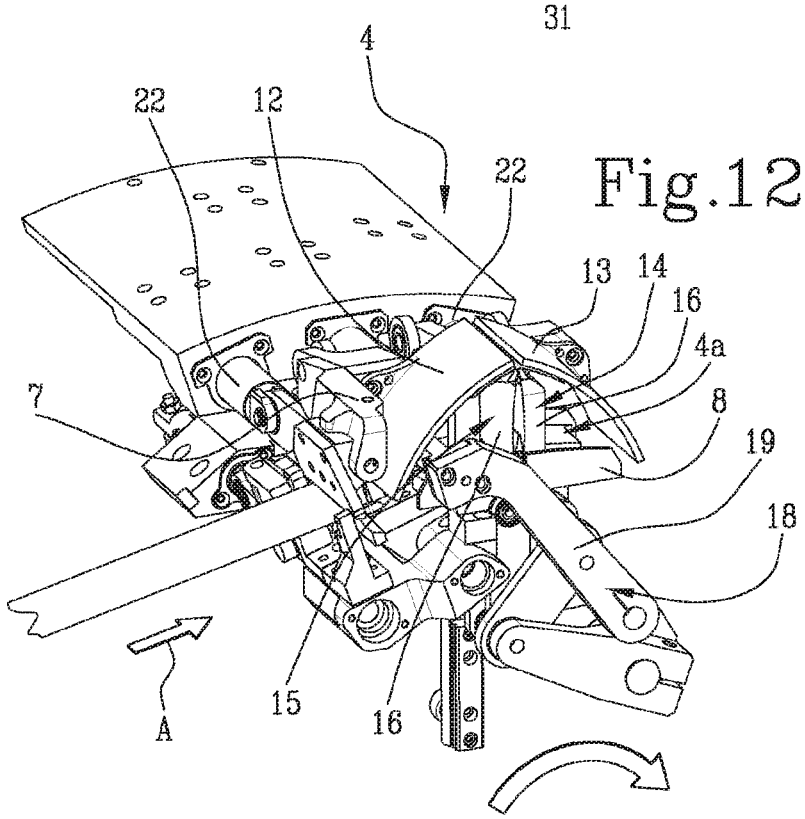
FIGS. 12 to 14 are perspective views, each illustrating one of a plurality of stations arranged on the carousel shown in FIG. 6 in further corresponding different operating configurations for forming the filter bag.

In light of this, each first 12 and second 13 tile are movable, in a synchronised fashion or in alternating reciprocal fashion with the other tile, between a first withdrawn non-operating position, wherein each first 12 or second 13 tile is positioned away from the operating portion 4*a* of the first station 4, and a forward operating position for covering, wherein the first 12 or the second 13 tile, by means of roto-translation, is positioned above the operating portion 4*a* and in contact, below, with a corresponding stretch of the piece 1*a* of filter material (see FIGS. 9, 10 and 12).

More specifically, the two tiles 12 and 13, which together form an arc of 180°, can move independently of each other or simultaneously and, when moved to an operating position, completely cover the operating portion 4*a*.

Each first and second tile 12 and 13, in the operating position, carry the respective lower end substantially in contact with the ends 1*d*, 1*e* of the piece 1*a*, projecting from the corresponding cradles 8, 9 and from the tiles 12 and 13.

The first and second tile 12 and 13 form a contrast on the ends 1*d* and 1*e* of the piece 1*a* during separation of the latter from the continuous strip of filter material (in synergy with the folder 10 and the counter-folder 11) and guide the folding step (as described in more detail below).

Figure 11:
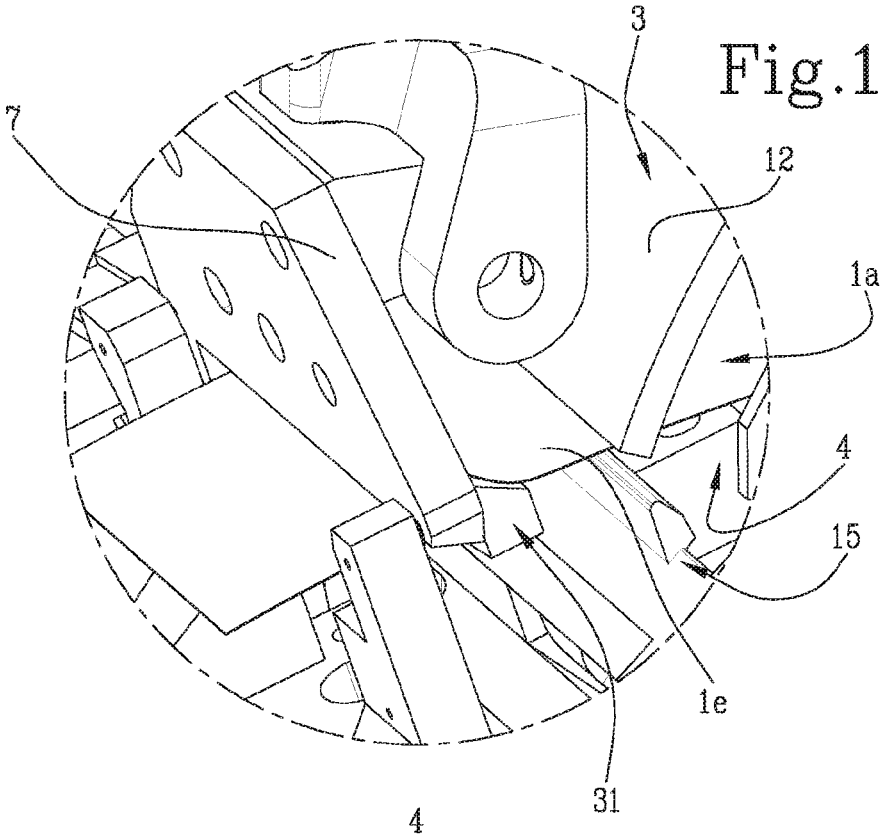
FIG. 11 illustrates an enlarged detail of FIG. 10.

In confirmation of the above, preferably each cutting means 7 is associated with a first 12 or second 13 covering tile positioned upstream of the operating portion 4*a* of the corresponding first station 4 with respect to the feed line A (in the case illustrated in FIGS. 9 to 11, it is the first tile 12 positioned upstream of the cradles 8, 9 with respect to the feed line A).

In light of this, the cutting means 7 are configured to separate from the continuous strip of filter material the piece 1*a* of filter material positioned in the operating portion 4*a* of the corresponding first station 4, at the passage of the first 12 or second 13 tile from the withdrawn non-operating position to the forward operating position.

In other words, the cutting means 7 are integral outside the lower part of the first tile 12 and during the roto-translational movement of the first tile 12 to an operating position the cutting means 7 intercept the continuous strip of filter material and separate it from the part housed in the operating portion 4*a* of the first station 4.

It should be noted that the cutting means 7 comprises an upper knife integral outside the first tile 12 and a lower counter-knife 31 fixed and positioned on the outer edge of the first carousel 2 and facing the knife in such a way as to be beneath the continuous strip of filter material during its feeding to the corresponding first stations.

It should be noted that during the step of feeding the continuous strip of filter material and during the step of separating the piece 1*a* of filter material the tiles 12, 13 move as follows:

- both the tiles 12 and 13 are in a withdrawn non-operating position during the feeding of the continuous strip along the operating portion 4*a* of the first station 4;
- the second tile 13 downstream moves to an advanced operating position immediately after the arrival in the position of the continuous strip on the cradles 8, 9 and in synchrony with or following the locking of the strip by the folder and central counter-folder 10 and 11;
- the first tile 12 upstream then moves to an advanced operating position after which the cutting means 7, integral with the tile 12, separates the piece 1*a* from the continuous strip of filter material.

Figure 5:
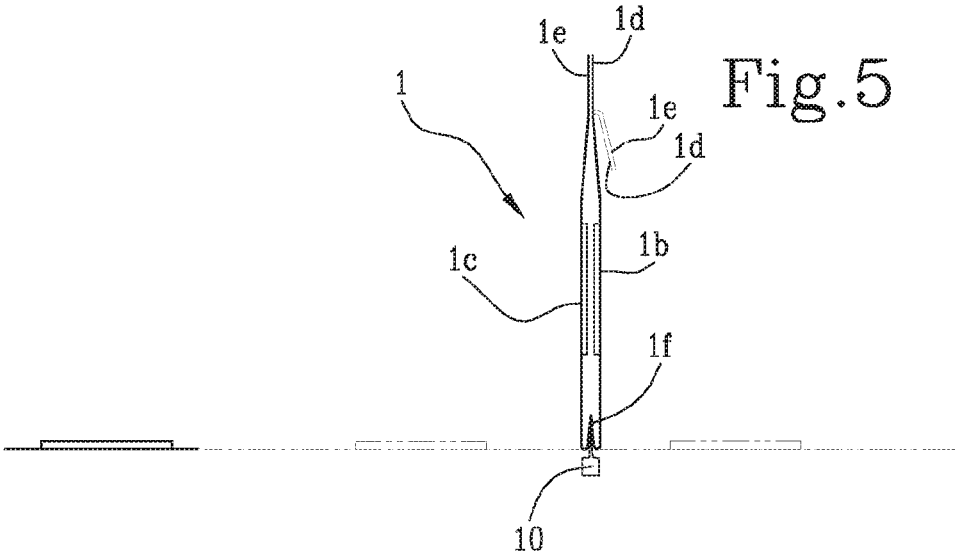
Figure 13:
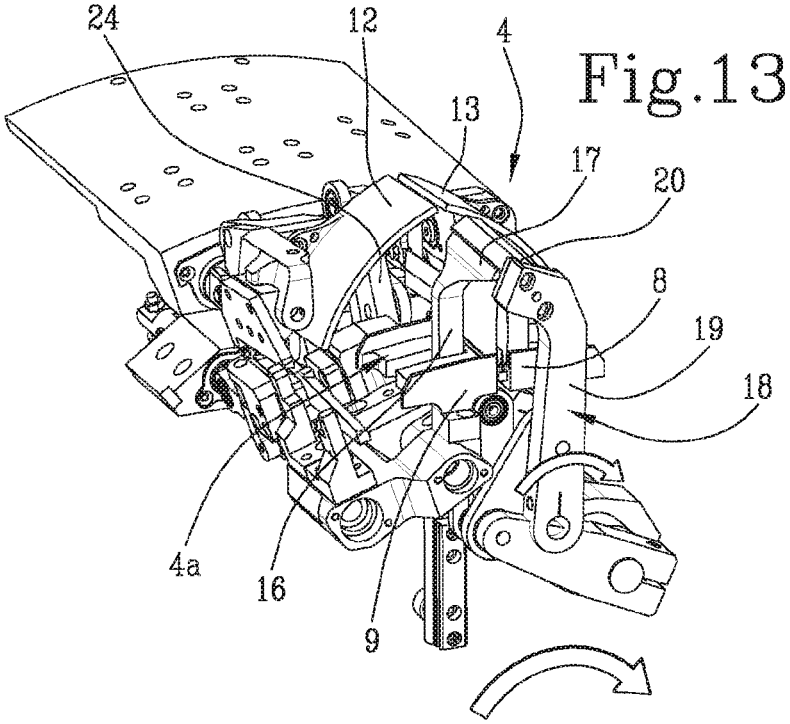
Figure 14:
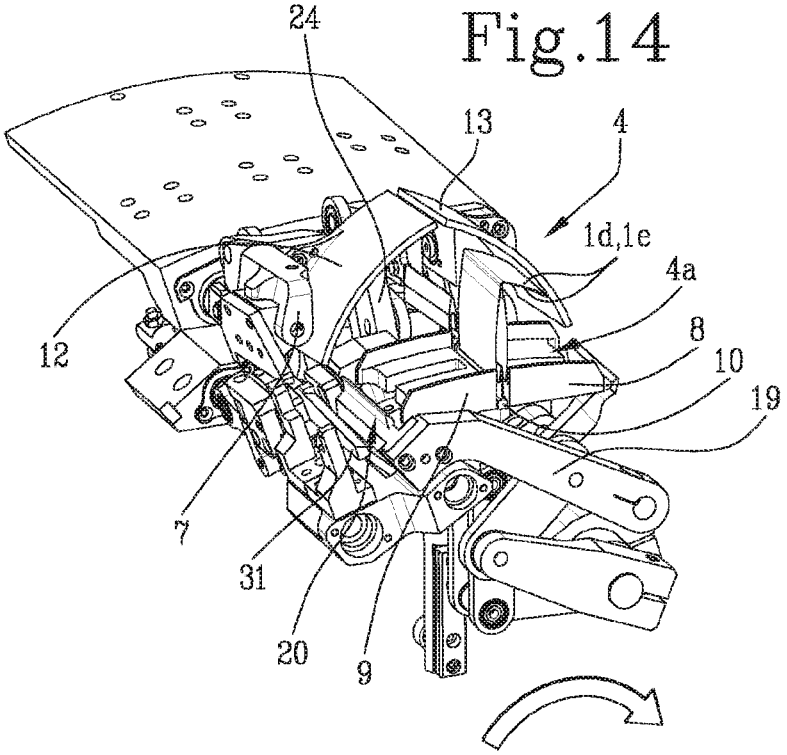

Preferably, each first station 4 comprises a first 14 and a second 15 lifting unit configured to rotate a corresponding chamber 1*b*, 1 *c* of the piece 1*a* of filter material positioned in the operating portion 4*a* of the first station 4, from a first position wherein the two chambers 1*b*, 1 *c* lie in the operating portion 4*a* (that is, on cradles 8, 9), to a second raised position wherein the two chambers 1*b*, 1 *c* are close together with the corresponding free ends 1*d*, 1*e* in contact (see FIGS. 5, 13 and 14).

Each first 14 and second 15 lifting unit has an operating arm 16 and a contact head 17 configured for pushing the corresponding chamber 1*b*, 1*c*.

In light of this, each operating arm 16 is articulated about an axis X16 parallel to the first axis 2X of rotation positioned below the operating portion 4*a* and configured in such a way as to perform a simultaneous rotation and in opposite directions of the corresponding arms 16 so as to allow the contact heads 17 to intercept the corresponding free ends 1*d*, 1*e* of the piece 1*a* positioned along the operating portion 4*a*, lift them to an upright position and keep the chambers 1*b*, 1*c* in a an upright position and positioned radially relative to the first axis 2X of rotation (see FIGS. 12 and 13).

As described below, the translation devices 5 are configured to allow a synchronised raising and lowering movement of the levers 16 in opposite directions.

FIGS. 13 and 14 show how the two contact heads 17 are positioned, in the non-operating position, close to the outer ends of the two cradles 8, 9 on which rest the two chambers 1*b* and 1*c* of the piece 1*a* of filter material.

It should also be noted that the step of folding the chambers with doses 1*b* and 1*c* is performed with the first and second tile 12 and 13 in the advanced operating position in such a way as to guide and hold the free ends 1*d* and 1*e* of the piece 1*a* of filter material in a folded position (with the opposite direction to the direction of folding) and so as to prevent dispersion of product during the continuous rotation of the first carousel 2.

In effect, each contact head 17 comes into contact with the corresponding chamber 1*b* or 1*c* with doses in a zone close to the ends 1*d* and 1*e*, but leaving the ends projecting relative to the contact heads 17.

Preferably, each first station 4 comprises a tipping element 18 configured for folding the raised ends 1*d*, 1*e* of the two chambers 1*b*, 1*c* of the piece 1*a* of filter material towards the outside of one of the two chambers 1*b*, 1*c*.

In light of this, the tipping element 18 has an operating rod 19 articulated to an axis X19 parallel to the first axis 2X of rotation and positioned on the outside of the operating portion 4*a*, that is to say, beyond the outer edge of the first carousel 2.

The tipping element 18 has a folding head 20 associated with the operating rod 19 positioned transversally to the operating rod 19 and inside the operating portion 4*a* of the first station 4.

The head 20 is positioned parallel with one of the contact heads 17 of a first or second lifting unit 14 or 15.

The tipping element 18 is movable between a non-operating position, wherein the folding head 20 is positioned at a first height and away from the piece 1*a* of filter material (see FIGS. 10 and 14), and an operating position wherein the folding head 20 is rotated to a second height greater than the first height, in such a way as to intercept and fold the free ends 1*d*, 1*e* of the piece 1*a* of filter material above the first and second lifting units 14, 15 arranged in the operating position.

More in detail, the tipping element 18 is configured to keep the folding head 20, in the non-operating position, in an area of the operating portion 4*a* of the first station 4 interposed between the area engaged by one of the contact heads 17 of a lifting unit 15 (the one upstream relative to the feed line A) and the lower end of the first tile 12 upstream: in this way, the rotation of the bar 19 is such that the two ends are folded towards the outer part of the chamber containing a dose facing towards the second tile 13 downstream relative to the feed direction A.

The rod 19 of the tipping element 18 has an extension such as to allow the folding head 20 to have an arc of rotation greater than the height reached by the two contact heads 17 in the operating position.

All the operating components described up to now may be moved thanks to the above-mentioned first plurality of translation devices 5.

This first plurality of first translation devices 5 comprise kinematic means 21, 22, 23, 24, 25 for connecting and moving between the corresponding first station 4 and the corresponding gripping means 3 with corresponding cam means 26, 27, 28, 29, 30 made along an inner surface of the first carousel 2 away from the outer edge.

As already mentioned, the kinematic means 21-25 are positioned, at least partly, inside the corresponding first operating station 4 and form at least a part of the corresponding gripping means 3.

The interaction between a part of these kinematic means 21-25 and the cam means 26-30 allows the translation of the first gripping means 3 (end operating portions of the kinematic means) relative to the corresponding first operating stations 4 and also the operating movement of the first stations 4 along directions which are parallel or transversal to the first axis 2X of rotation.

Figure 16:
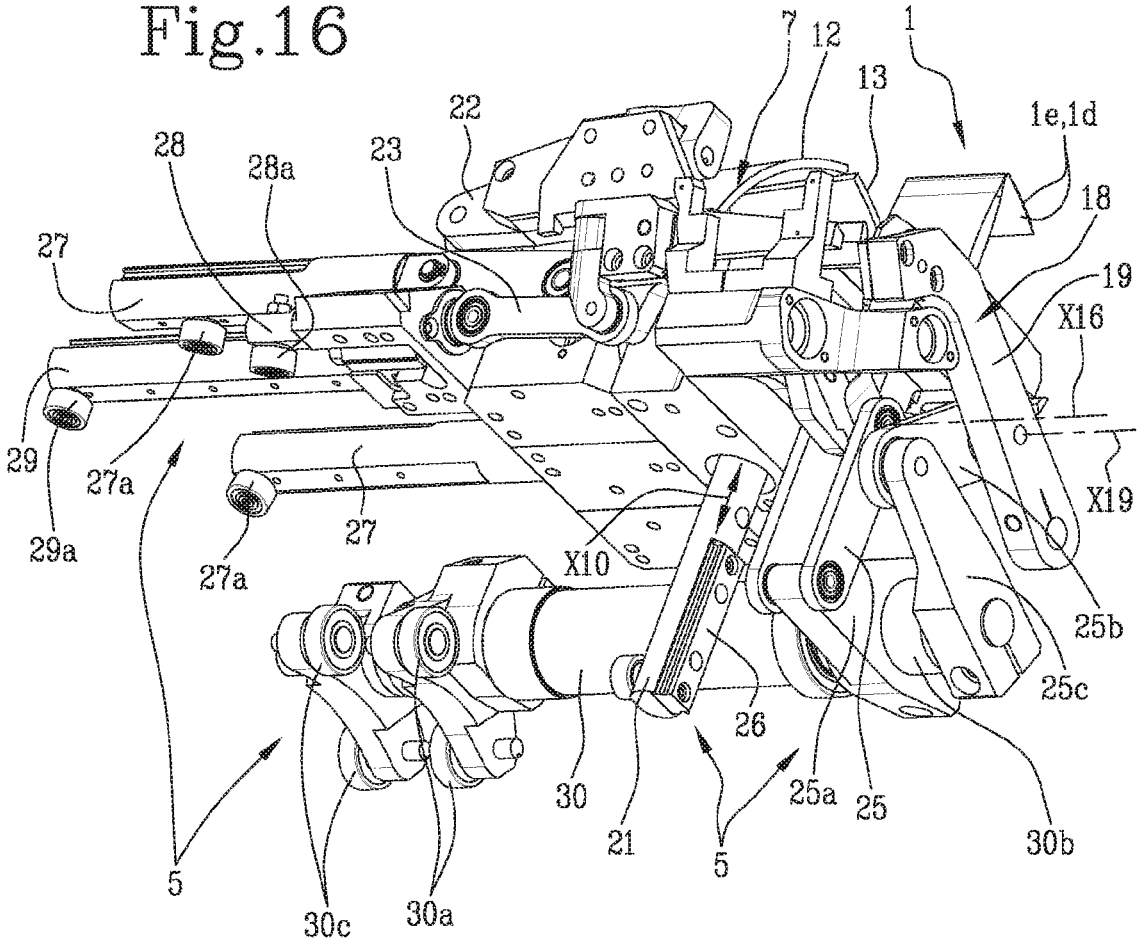
FIG. 16 is a perspective view from below of a single operating station of the carousel of FIG. 6.

As illustrated in FIGS. 6 and 16, these kinematic means 21-25 and the cam means 26-30 are structured as follows:

- the central folder 10 is the end part controlled by a first cylinder 21 positioned radially relative to the first axis 2X of rotation; the first cylinder 21 is provided with a guide 26 slidably guided inside the first carousel 2 to allow the vertical movement of the central folder 10;
- the counter-folder 11 is the end part served by a four-bar linkage 24 (which is able to move the counter-folder by roto-translation and shown in FIGS. 13 and 14) controlled by a second cylinder 29 having linear guides of axial constraint (for moving only parallel to the first axis 2X of rotation) and cam follower rollers 29*a* coupled in circular inner cam tracks to the first carousel 2;
- the first and the second tile 12 and 13 are the end part each served by a four-bar linkage 22 (which is able to move each tile 12 and 13 by roto-translation) controlled by a third cylinder 27 having linear guides of axial constraint (for moving only parallel to the first axis 2X of rotation) and cam follower rollers 27*a* coupled in circular inner cam tracks to the first carousel 2;
- the cutting means 7, integral with the first tile 12, is the end part served, only for the cutting movement, by an eccentric lever system 23 controlled by a corresponding fourth cylinder 28 having linear guides of axial constraint (for moving only parallel to the first axis 2X of rotation) and cam follower rollers 28*a* coupled in circular inner cam tracks to the first carousel 2;
- the first and second lift units 14 and 15 are the end part served by a connecting rod 25 for controlling the two arms 16; the connecting rod 25 is articulated, through an arm 25*a*, to a fifth cylinder 30 comprising cam follower rollers 30*a* coupled in circular inner cam tracks to the first carousel 2;
- the tipping element 18 is the end part served by a connecting rod 25*b* articulated to an arm 25*c* connected to a sixth cylinder 30*b* which is coaxially coupled with the fifth cylinder 30, but free to rotate relative to the fifth cylinder 30; the sixth cylinder 30*b* has at its free end cam follower rollers 30*c* coupled in circular inner cam tracks to the first carousel 2.

Therefore, each gripping means 3 consists of an operating terminal connected to a component forming part of the translational device 5, which is positioned inside the first operating station 4.

It should be noted that the above-mentioned operations on the piece of filter material are performed by each first station during an angle of rotation of the first carousel 2 not greater than a flat angle. Preferably, each first station performs all the operations along an angle of rotation of the first lower carousel at a flat angle.

In a solution illustrated in FIG. 15, each first station 4 of the first carousel 2 releases the piece 1*a* of filter material manipulated to a second rotary carousel 32 continuously rotating about a second axis 32X and having a corresponding plurality of second operating stations 33 and a corresponding plurality of second gripping means 34 which are able to performs further operations on the piece 1*a* of filter material (the second carousel is illustrated schematically merely by way of an example).

The preset aims are fully achieved with the machine structure just described.

In effect, a machine according to the invention is extremely flexible, configurable as a function of the filter bag to be made, and with a high productivity.

It should be noted that each individual operation on the piece of filter material, or on the filter bag, is no longer linked to the pause time (as in the machines with step-mode operation) and has a duration independent from one another. It is therefore possible to lengthen or shorten, as necessary, the time of execution of an operation (in this case, for example, folding the piece of filter material and closing the free ends) simply by using a longer or shorter stretch of rotation of the movement carousel.

It should be noted that a machine according to the embodiment of the invention according to which the translation devices move the gripping means and the operating stations remain stationary relative to the respective movement carousel is particularly simple from the constructional point of view.

Each unit may operate on the piece of filter material along an extremely short arcuate stretch of the carousel and, thanks to the presence of the translation devices, may receive and release the piece quickly and with the possibility of starting the operations immediately, reducing the down times and the dimensions of the machine.

The invention claimed is:

1. A machine for making filter bags for infusion products starting from pieces of filter material, each of the pieces of filter material having two free ends and an intermediate portion between the two free ends, the intermediate portion having two chambers containing a corresponding dose of product; the pieces of filter material advancing along a feed line, the machine comprising:

a first movement carousel for continuous rotary movement about a first axis of rotation and having a circumferential surface extending parallel to the first axis of rotation;

a plurality of first gripping elements positioned along, and continuously movable with, the first movement carousel, each of the plurality of first gripping elements being configured for holding a respective one of the pieces of filter material being formed; the plurality of first gripping elements being distributed and equidistant along an entire circumferential surface of the first movement carousel;

a plurality of first operating stations positioned along, and continuously movable with, the first movement carousel, each of the plurality of first operating stations being associated with a respective one of the plurality of first gripping elements and being configured to operate on the piece of filter material in order to form, at least partly, a filter bag along at least one predetermined angular stretch of rotation of the first movement carousel; the plurality of first operating stations being arranged equidistant along the entire circumferential surface of the first movement carousel; and a plurality of first translation devices, connected to the first movement carousel and configured for translating the plurality of first gripping elements along a direction parallel to the first axis of rotation to move each of the plurality of first gripping elements toward the respective pieces of filter material at least along an angular stretch of the feed line; the plurality of first translation devices being arranged equidistant along the entire circumferential surface of the first movement carousel; each of the plurality of first translation devices being positioned, at least partially, on a corresponding one of the plurality of first operating stations, to define at least a part of a corresponding one of the plurality of gripping elements.

2. The machine according to claim 1, comprising a plurality of cutting elements positioned on, and movable in rotation with, the first movement carousel, each of the plurality of cutting elements being positioned with the corresponding first gripping means for separating from a continuous strip of filter material the pieces of filter material.

3. The machine according to claim 1, and further comprising a forming unit configured for forming, and feeding to the first movement carousel, a continuous strip of filter material having a series of the chambers with the doses of product positioned one after another along the feed line.

4. The machine according to claim 1, wherein each of the plurality of first operating stations comprises an operating portion fixed on a first part of a circumferential surface of the first movement carousel, positioned parallel to the first axis close to an outer edge of the first movement carousel; the operating portion being configured to receive the respective one of the pieces of filter material.

5. The machine according to claim 4, wherein each of the plurality of first operating stations comprises two cradles positioned along the feed line and placed in the operating portion; the two cradles being configured to receive from a forming unit, and to support along the feed line, a portion of a continuous strip of the filter material having the chambers with doses of product.

6. The machine according to claim 4, wherein each of the plurality of first gripping elements comprises a folder and a counter-folder configured to cooperate for folding the intermediate portion of the one of the pieces of filter material when positioned in the operating portion of each of the plurality of first operating stations; the folder being movable, synchronized with the counter-folder, along an axis radial relative to the first axis of rotation; the counter-folder being configured to move between a withdrawn non-operating position, wherein the counter-folder is moved away from the operating portion, and a forward folding operating position, wherein the counter-folder, is positioned in the operating portion and facing the folder with the intermediate portion of the one of the pieces of filter material interposed between the folder and the counter-folder, in such a way as to have the one of the pieces of filter material in a predefined position on the operating portion.

7. The machine according to claim 4, wherein each of the plurality of first gripping elements comprises a first tile and a second tile for covering the operating portion; each first tile and second tile being movable, in a synchronized fashion or in alternating reciprocal fashion, between a withdrawn non-operating position, wherein each of the first tile and/or second tile is positioned away from the operating portion of the each of the plurality of first operating stations, and an operating position, wherein each of the first tile and the second tile are positioned above the operating portion and in contact at a bottom portion with the one of the pieces of filter material.

8. The machine according to claim 4, wherein each of the plurality of cutting elements is positioned with a first tile or second tile and is positioned upstream of the operating portion of the corresponding each of the plurality of first operating stations with respect to the feed line; the each of the plurality of cutting elements being configured to separate from the continuous strip of filter material the one of the pieces of filter material positioned in the operating portion of the corresponding each of the plurality of first operating stations.

9. The machine according to claim 4, wherein each of the plurality of first operating stations comprises a first lifting unit and a second lifting unit configured to rotate a corresponding chamber of the one of the pieces of filter material positioned in the operating portion of the first station, from a first position wherein the two chambers lie in the operating portion, to a second raised position wherein the two chambers are close together in an upright position on the operating portion with the corresponding free ends joined in contact; each first lifting unit and second lifting unit having an operating arm and a contact head configured for pushing a respective chamber of the one of the pieces of filter material; each operating arm being articulated about an axis parallel to the first axis of rotation positioned below the operating portion and configured to perform a simultaneous rotation and in opposite directions with respect to the other operating arms, so as to allow the contact heads to intercept the corresponding chambers positioned along the operating portion, and lift the corresponding chambers to an upright position, in such a way as to keep the two chambers radially relative to the first axis of rotation.

10. The machine according to claim 4, wherein each of the plurality of first operating stations comprises:

a tipping element configured to fold the joined ends of the two chambers of the piece of filter material towards an outside of one of the two chambers; the tipping element having an operating rod articulated to an axis parallel to the first axis of rotation and positioned outside the operating portion, beyond an outer edge of the first movement carousel;

the tipping element having a folding head connected transversely with the operating rod and inside the operating portion; the tipping element being movable between a non-operating position, wherein the folding head is positioned at a first height below the one of the pieces of filter material, and an operating position wherein the folding head is rotated to a second height greater than the first height, so as to intercept and fold the two free ends of the one of the pieces of filter material.

11. The machine according to claim 1, wherein the plurality of first translation devices comprise kinematic elements for connecting and moving the corresponding one of the plurality of first operating stations and the corresponding one of the plurality of first gripping elements via a corresponding cam element formed along an inner surface of the first movement carousel away from an outer edge of the first movement carousel; the kinematic elements being positioned, at least partially inside the corresponding one of the plurality of first operating stations and forming at least a part of the corresponding one of the plurality of first gripping elements; the kinematic elements and the cam elements being configured to allow a translation of the corresponding one of plurality of first gripping elements relative to the corresponding one of the plurality of the first operating stations and an operational movement of the corresponding one of the plurality of first operating stations along directions which are parallel with or transversal to the first axis of rotation.

* * * * *